US007322204B2

(12) United States Patent
Hirao et al.

(10) Patent No.: US 7,322,204 B2
(45) Date of Patent: Jan. 29, 2008

(54) LOW TEMPERATURE ZONING FORMATION SYSTEM FOR HOLDING FRESHNESS OF FOOD

(75) Inventors: Yasuhiro Hirao, Koto-ku (JP); Kazuo Hariu, Koto-ku (JP); Hiroyuki Nakagawa, Koto-ku (JP); Kousaku Nishida, Koto-ku (JP)

(73) Assignee: Mayekawa Mfg. Co., Ltd., Tokyo (JP)

( * ) Notice: Subject to any disclaimer, the term of this patent is extended or adjusted under 35 U.S.C. 154(b) by 204 days.

(21) Appl. No.: 10/508,056

(22) PCT Filed: Mar. 18, 2003

(86) PCT No.: PCT/JP03/03281

§ 371 (c)(1),
(2), (4) Date: Jun. 14, 2005

(87) PCT Pub. No.: WO03/078908

PCT Pub. Date: Sep. 25, 2003

(65) Prior Publication Data

US 2005/0223729 A1 Oct. 13, 2005

(30) Foreign Application Priority Data

Mar. 19, 2002 (JP) ..... 2002-075993

(51) Int. Cl.
*A47F 3/04* (2006.01)

(52) U.S. Cl. ..... 62/255; 62/257; 62/434

(58) Field of Classification Search ..... 62/246–256, 62/407–424, 440–441, 257
See application file for complete search history.

(56) References Cited

U.S. PATENT DOCUMENTS

| | | | | |
|---|---|---|---|---|
| 2,932,955 | A * | 4/1960 | Hargrave et al. | 62/255 |
| 3,333,437 | A * | 8/1967 | Brennan | 62/256 |
| 4,505,131 | A * | 3/1985 | Boxall | 62/407 |
| 5,477,702 | A * | 12/1995 | Kennedy et al. | 62/256 |
| 5,590,541 | A * | 1/1997 | Rainwater | 62/255 |
| 5,797,279 | A * | 8/1998 | Osborne | 62/381 |
| 6,185,951 | B1 * | 2/2001 | Lane et al. | 62/246 |
| 6,539,741 | B2 * | 4/2003 | Navarro | 62/256 |

FOREIGN PATENT DOCUMENTS

JP 64-28778 U 2/1989

(Continued)

*Primary Examiner*—William E. Tapolcai
(74) *Attorney, Agent, or Firm*—Crowell & Moring LLP

(57) ABSTRACT

A low temperature zone forming system by convection type thermal stratification in which the low temperature zone separated from polluted outside air is formed on a movable or fixed table for handling commodities such as marine products while maintaining freshness thereof during the period from carrying-in in the whole sale market, during selling by auction, until shipment of the commodities from the market, comprising an upward-open case body (30) mounted on a chassis (30*a*), a separate brine chilling unit (30*b*), and a brine piping (30*c*), the upward-open case body (30) further comprising a roller conveyer (35) installed in the center part of the floor of the case body (30), cooling flat plates each of which is installed adjacent to the roller conveyer (35), and cooling flat plates are installed on the inside faces of both laterally longitudinal side walls.

18 Claims, 10 Drawing Sheets

FOREIGN PATENT DOCUMENTS

| | | |
|---|---|---|
| JP | 2-20076 | 2/1990 |
| JP | 3-54384 | 11/1991 |
| JP | 3-115375 | 11/1991 |
| JP | 5-19882 | 3/1993 |
| JP | 6-185780 | 7/1994 |
| JP | 11-287545 | 10/1999 |
| JP | 2000-14315 | 1/2000 |
| JP | 2000-142974 | 5/2000 |
| JP | 2001-108346 | 4/2001 |
| TW | 290627 | 11/1996 |
| TW | 356510 | 4/1999 |

* cited by examiner (A)

(B)

(A)

(B)

LOW TEMPERATURE ZONING FORMATION SYSTEM FOR HOLDING FRESHNESS OF FOOD

TECHNICAL FIELD

The present invention relates to a low temperature zone forming system required not only in a food processing factory such as a meat and marine products processing factory but also for the transport and temporal storage of foodstuffs in a whole sale market of marine products, fruits and vegetables, etc., specifically to a low temperature zone forming system to maintain freshness of food such as marine products by forming a low temperature zone on a portable or fixed table used in a whole sale market where food such as marine products, etc. are handled and where it is necessary to maintain freshness of said marine products after carrying-in in the market, during auction in the market, and until forwarding form the market.

BACKGROUND ART

At the auction in a marine products wholesale market, for example in a fish market where fishes are landed from fisher boats, the landed fishes are sorted, cleaned, and arranged directly on the floor of the auction market in a heap of about 40 cm square separately according to fisher boats landed the fishes and to the kind of fish to prepare for auction. Auction site extends to about 300 m long, considerable time is needed until the last auction finishes, and there have been problems of drying and rising in temperature of fishes caused by being exposed to wind and sunlight.

In a whole sale market, collection, sorting, storing, trading, transportation, and disposal of fresh marine products are done in a short time, during which nearly all or all of the fresh marine products are exposed to outside air and transferred from owners to buyers. During that time period, the fresh marine products are exposed to an atmosphere contaminated with exhaust gases, bacteria, etc. It is desired particularly in the case of trading fresh marine products that trading is done in a state the fresh marine products are accommodated in a low temperature zone separated from said contaminated atmosphere. That is, a low temperature storage facility is required in a whole sale market for the purpose of hygiene and maintaining freshness of the products.

As to such a low temperature zone forming system as mentioned above, there have not been disclosed much proposals directly applicable to such situation. A proposal relating to a refrigerating apparatus in which a cold air curtain is formed across the opening of the apparatus was disclosed, for example, in Japanese Laid-Open Utility Model Application No. 01-28778.

The proposal relates to a refrigerating apparatus in which an air curtain is formed across the opening through which commodities are gotten in and out of the apparatus.

The apparatus is composed as shown in FIG. 9. A show case body 51 has a storage room 52 for accommodating commodities and an opening 53 is provided for getting the commodities in and out of the storage room. On both sides of the opening 53 are formed an air admission port 55 for sucking in cold airflow 54 and an air outlet port 56 to blowing out cold airflow 54, both the ports opposing to each other.

In the passage 57 under the bottom of the storage room 52 communicating the air admission port 55 with the air outlet port 56 are located a blower 58 for forcing circulation air, an evaporator 60 for cooling the circulation air in an ordinary operation, and a heat exchanger 59 for cooling the circulation air when defrosting the evaporator. In a base frame 61 are located a condenser 62 and compressor 63 of a refrigerating machine.

In an ordinary operation, refrigerant circulates from the compressor 63 through the condenser 62, heat exchanger 59, expansion valve not shown in the drawing, and evaporator 60 where the circulation air is cooled by the evaporation of the refrigerant, to be returned to the compressor 63. The high-pressure, high-temperature refrigerant gas compressed in the compressor 63 is cooled in the condenser 62 to be condensed to a liquid state, the liquid refrigerant is supercooled in the heat exchanger 59 and then expanded through the expansion valve to be evaporated in the evaporator 60 to cool the circulation air.

When defrosting the evaporator, the refrigerant is circulated from the compressor 63 through the condenser 62, evaporator 60, and heat exchanger 59 to be returned to the compressor 63. The evaporator 60 is defrosted by the sensible heat of the liquid refrigerant from the condenser 62. The liquid refrigerant supercooled through the defrosting process flows by way of an expansion valve not shown in the drawing to the heat exchanger 59 where it evaporates and cools the circulation air.

According to the proposal, as defrosting operation is possible by inverting the direction of the refrigerant circulation in an ordinary operation and the defrosting operation is done while the cooling circulation air is done, the rise in temperature in the storage room during defrosting is prevented. As an air curtain is formed across the opening of the storage room, the apparatus can maintain freshness of fresh marine products accommodated in the storage room.

Besides said proposal, a proposal relating to belt conveyer equipment for transferring cold food used to transfer and dispose foodstuffs and food articles in food processing factories such as meat, marine products processing factories, etc. was disclosed recently, for example, in Japanese Laid-Open Patent Application No. 11-287545. The equipment is composed as shown in FIG. 10. Cold air blow out openings 74*a* and admission openings 74*b* opposing to each other across the belt conveyer 72 are provided on both left and right sides along the transfer direction S of a belt conveyer 72 for transferring cold food, and cold space R is produced on the belt by the cold air.

A cooling section 75 is provided in the space between the upper, transfer side belt 72*a* and lower, return side belt 72*b* of the belt conveyer 72. Cold air cooled in the cooling section is sent to the cold air blow out openings 74*a* to be blown out onto the surface of the transfer side belt 72*a* and sucked from the admission openings 74*b*, thus the cold air is circulated.

With the composition mentioned above, cold space R is produced on the surface of the transfer side belt 72*a* and at the same time the rear side thereof is also cooled.

The above proposal can be applied to a low temperature zone forming system required not only in a food processing factory such as a meat, marine products processing factory but also for transferring and temporally storing foodstuffs in a wholesale market of marine products or fruits and vegetables.

As to a low temperature forming system in which an atmosphere of low temperature shielded from an outside contaminated atmosphere is formed, there has been no proposal directly applicable to the situation concerned. Proposals of heat storage tank in which heat is stored in a thermally stratified state have been disclosed hitherto. An example of such a proposal uses a thermal stratification type heat storage tank in which the difference in density of water depending on the temperatures thereof is utilized to store water in a stratified state without allowing hot water lower in density to mix with cold water high in density.

Besides said proposal, an apparatus and method for displaying and storing hauled fishes was disclosed in Japanese Laid-Open Patent Publication No. 2000-14315, in which hygiene and quality problems induced by the auction of hauled fishes arranged on the floor of the market was solved and hygienic storage of hauled fishes was made possible.

The display and storage apparatus is composed, as shown in FIG. 11, of a cooling part which is a cooling panel 78*a* with a brine passage 78*b* formed inside thereof and an insulation part 79 attached to the bottom thereof, hauled fishes being possible to be displayed on the surface of the cooling panel. Brine usable for food is supplied to the brine passage to cool the cooling panel. The apparatus is provided in a fish market and the distribution process is carried out on the display and storage apparatus.

As can be seen in the proposals mentioned above, it is required in a market that, a space formed into a box shape which can be moved as necessary is provided as a commodity storage facility, and the outside air including warm air in the space is driven out and instead cold air is supplied into the space to speedily replace the atmosphere inside the space by an cold atmosphere of uniform temperature distribution.

As a method of the displacement, there has been known a method of forming a fresh air zone in the lower part of a room near the floor where people reside or work by utilizing the thermal stratification of air caused by the temperature difference between the temperature of the air-conditioned air supplied to the room and that of the warm air heated by the heat generated in the room. As such was disclosed in Japanese Laid-Open Patent Application No. 06-185780 a method and apparatus for ventilation. According to the proposal, as shown in FIG. 12, air-conditioned air 82 lower in temperature than the temperature of the air inside the room 80 is blown out at low speed from a ventilation air outlet 81 located near the floor of the room 80, and nozzles are located near the ceiling for producing high speed air jet streams 83 to allow the air in the room near the ceiling to be ejected accompanied with the air jet streams through an exhaust opening located near the ceiling. Thus, ventilation can be performed efficiently.

However, with the prior art disclosed in said Japanese Laid-Open Utility Model Application No. 01-28778, there is a problem that the surfaces of the commodities dry out, for cold air for forming the air curtain strikes the accommodated commodities such as marine products.

Further, there is also a problem that cleaning is vexatious and accompanies difficulty because the air admission port, air outlet port, fan, etc. are located in the rear side of the cold storage room for accommodating marine products as commodities.

Further, the proposal is related to the utilization of an air curtain of cold air for shielding the cold storage room from outside atmosphere and there is no description about maintaining the storage room in low temperature.

Further, as the apparatus includes a cold air circulation mechanism (a heat exchanger, fan, air admission port, and air outlet port), the space for displaying commodities is limited and there is a problem that it accompanies difficulty to place the apparatuses to match the structure and availability of a market.

The prior art disclosed in said Japanese Laid-Open Patent Application No. 11-287545 is composed such that a cold space is formed on a belt conveyer for transferring processed cold food article by blowing cold air, and there is a problem similar to that which exists in said Japanese Laid-Open Utility Model Application No. 01-28778.

The prior art disclosed in said Japanese Laid-Open Patent Application No. 2000-14315 is related to low temperature storage using a cooling panel. The panel is used only for placing marine products such as hauled fishes thereon and there is no description about efficiently forming a low temperature zone around the hauled fishes placed on the panel.

The prior art disclosed in said Japanese Laid-Open Patent Application No. 06-185780 is related to the displacement of the air inside a room utilizing a well-known method of thermal stratification and not related to the formation of a low temperature zone for storing fresh foodstuffs such as marine products.

By the way, as mentioned before, low temperature storage facilities for the purpose of sanitation and maintaining freshness of foodstuffs are required in central whole sale markets handling mainly marine products, fruits and vegetables and prefabricated refrigerators or low temperature forming facilities are beginning to be provided there recently.

A displaying facility of hauled fishes capable of being removed easily, not a permanent facility, was proposed by the applicants of the present application and others.

Said proposal relates to a displaying and storing equipment to surround an auction market and fill the surrounded space with cold air.

The cooling system of the proposal for forming a cold zone is an open type, local cooling system in which the cold air is not recovered, and there is room for improvement. On the other hand, need for a low temperature storage facility is increasing and a low cost, compact, and highly efficient facility is desired.

Currently, the handling operation of fresh foodstuffs such as marine products from arrival to shipment in a market is done under ordinary temperature in many cases, and improvement from the viewpoint of hygiene and maintaining freshness is strongly demanded.

Presently, as to lowering the temperature in an auction market, there are attempts to include a whole auction market in a large box type facility, but in this case the reception of goods, prearrangement for auction, preliminary inspection, and shipment must be carried out under low temperature for a long time period and there arises a problem of maintenance of good health of workers working under a low temperature atmosphere.

DISCLOSURE OF THE INVENTION

The present invention is made in light of the problems mentioned above, and the object is to provide a low temperature zone forming system for maintaining freshness of foodstuffs in which a low temperature zone separated from a contaminated atmosphere is formed on a movable or fixed table. By applying the system to a wholesale market handling mainly fresh foodstuffs, carrying-in of the fresh foodstuffs in the whole sale market, auctioning, and shipment thereof can be performed while maintaining freshness thereof.

① The present invention proposes a low temperature zone forming system including an upward-open case body for displaying commodities, the case body confining a space surrounded with the floor face and four side walls, to be used for maintaining freshness of fresh marine products in a whole sale market, characterized in that a thermally stratified low temperature zone having temperature distribution in a vertical direction is formed above said floor face.

In the invention, a concept of thermal stratification is introduced in the boxed space of an upward-open case body to be used in an auction market for displaying fresh foodstuffs such as marine products (hereafter referred to as commodities). A low temperature zone having temperature distribution in a vertical direction is formed above the floor of the upward-open case body surrounded with four side walls, and said commodities are displayed in the low temperature zone. By the formation of said thermally stratified low temperature zone, the movement of the cold air in the low temperature zone is interrupted by the warm air region in the upper part of the low temperature zone, and the low temperature can be maintained efficiently without being dispersed outward, so that the marine products is accommodated in an almost stationary low temperature space without the movement of air and the problem of damage in the quality of foodstuffs does not occur. The problem of contamination of foodstuffs by outside air is also prevented, for the contaminated air in the warm region consisting of outside air is shut off from entering the low temperature zone under the warm region.

② It is preferable that cold air is introduced in the lower part of said low temperature zone.

The above invention is related to the cold-air introduction type thermally stratified low temperature zone which is formed by introducing cold air from outside into the low temperature zone formed above the floor of the boxed space.

The condition of the low temperature zone is different depending on the introduction velocity of cold air. When cold air is introduced at a low velocity, the vertical temperature distribution in the low temperature zone is not influenced largely by the introduction of cold air and replacement of the cold air zone occurs under soft convection. When the velocity is large, formation of a new cold air zone occurs.

By the way, when outside air is cooled and directly introduced, it is required to filtrate the air.

The introduction of said filtered cold air from outside is necessary for the system to comply with a change in temperature or contamination of the air in the low temperature zone caused by carrying-in and -out or replacing commodities.

③ It is preferable that said cold air is introduced at low velocity in an ordinary operation and the introduction of cold air is switched to a forced introduction to form a stratified low temperature zone having a required temperature distribution in a vertical direction as necessary.

The above invention is related to the system composition for forcibly forming a low temperature zone consisting of a new temperature zone through forced introduction of cold air into the low temperature zone.

④ It is preferable that said floor is a heat exchanger having heat transfer faces on both sides thereof, one of the heat transfer faces forming a cooling floor face and the other of the heat transfer faces forming a heat transfer face to perform heat exchange in the cold air producing chamber formed in the rear face side of the floor, the warm air in the warm air zone in the upside opening region of said case body is introduced into said cold air producing chamber to be cooled therein, and the cold air produced in the chamber is introduced into the low temperature zone formed above said one of the heat transfer faces to form a new cold air stratified zone.

The above invention is related to a means for forming a low temperature zone in the boxed space of the upward-open case body surrounded by the floor and four side walls by the cold air introduction type thermal stratification according to the present invention. A cooling heat exchanger having a heat transfer face on both sides for cooling air is provided all over the floor face of the upward-open case body, one of the heat transfer face cools the air in the boxed space, the other heat transfer face cools the air in the cold air producing chamber formed under the floor, the warm air in the warm air region in the upper part of the low temperature zone is introduced into the cold air producing chamber to produce the cold air to be introduced to the low temperature zone to replace the air therein. It is preferable to filter the warm air to be introduced into the cold air production chamber before introduced thereinto.

⑤ It is preferable that said floor is a cooling flat plate having heat transfer faces on both sides thereof, one of the heat transfer faces forming a cooling floor face and the other of the heat transfer faces forming a heat transfer face to perform heat exchange in the cold air producing chamber formed in the rear face side of the floor, the warm air in the warm air zone in the upside opening region of said case body is introduced into said cold air producing chamber to be cooled therein, and the cold air produced in the chamber is introduced into the low temperature zone formed above said one of the heat transfer faces to form a new cold air stratified zone.

In the above invention, a cooling flat plate having heat transfer faces on both sides thereof is used instead of said heat exchanger.

⑥ It is preferable that a separate cooling panel is attached to the rear face of said floor, the cold air produced by means of the panel is forced into the low temperature zone above the floor to form a cold air stratified zone of required temperature.

The above invention is related to a means for forming a low temperature zone by the cold air introducing type thermal stratification capable of complying with forced cold-air introduction. By forcibly introducing the air cooled by the cooling panel installed on the rear face of the floor, whole of the low temperature zone is cooled and a new cold air zone can be formed in a short time to be able to comply with forced cold-air introduction.

⑦ It is preferable that said floor is a one-side-cooling flat plate having a flat heat transfer face on one side thereof, and the formation of the thermal stratification is possible in a short time period by concentrating cooling capacity to said heat transfer face.

In the above invention, a one-side-cooling flat plate having a flat heat transfer face on one side thereof is used instead of said heat exchanger. This is effectively used when forming a space for displaying commodities speedily in a wholesale market, etc.

⑧ It is preferable that the inside face of said four side walls and said floor face are composed to be cooling flat plates, so that convection type cold air stratified zone is formed by the low temperature zone formed by the convection between the descending cold air current produced due to the cooling of air by the cooling plates of the four side walls and the cold air zone produced due to the cooling of air by the cooling plates of the floor and the hot air region formed above said low temperature zone.

The above invention is related to a low temperature forming by convection type thermal stratification, which is anther type of low temperature zone formation different from the cold air introduction type low temperature zone forming.

In the low temperature zone formation by convention type thermal stratification, the low temperature zone is formed not only by the use of the cooling plate installed on the floor face but also of the cooling flat plates installed on the inside faces of the four side walls.

In this case, descending cold air current occurs along the cooling flat plates installed on the inside faces of the side walls, natural convection is induced by said air current and the cold air stratified zone formed on the floor face, and a low temperature zone having a thick cold air zone can be formed.

(9) It is preferable that cooling flat plates are provided on the inside faces of laterally longitudinal walls among the four side walls.

(10) It is preferable that a transfer section consisting of a roller conveyer is provided on a part of said floor in a laterally longitudinal direction or in a crosswise direction, and cooling flat plate or plates which can serve as chopping boards are provided in a position or positions other than the transfer section.

The above invention is related to the composition of the floor of the boxed space. A roller conveyer is installed on part of the rectangular floor in a longitudinal direction or crosswise direction and cooling flat plate or plates which serve as chopping boards are provided in a position or positions other than the transfer section. By this, the efficiency of carrying-in and -out of commodities to be displayed or commodities displayed is promoted and cross contamination by hand handling is reduced, and cooling flat plate or plates are provided adjacent to the roller conveyer which can serve as chopping boards. By using the cooling plate as a chopping board, the commodities can be cut as necessary before auctioning.

(11) It is preferable that the roller conveyer is provided on said floor in a laterally longitudinal direction.

(12) It is preferable that said four side walls can be turned over outward or detached, and when storing commodities in the case body, the walls are recovered to an erect state with the walls closely contacted with the floor to be able to again allow the formation of the low temperature zone.

The above invention is related to the structure of the side walls of the upward-open case body for forming a low temperature zone. The efficiency of cleaning is promoted by composing so that the walls can be turned over outward through connecting the lower ends of the walls by pivots or the walls are detachable in order to allow commodities to be carried-in or -out.

It is suitable to compose so that the side walls perpendicular to the roller conveyer can be detached. By this, when a plurality of the case body are connected with said side walls detached, the roller conveyer of each of the case bodies can be brought into communication with each other, and a long low temperature zone of which the length can be adjusted in accordance with market conditions and space. Further, by installing said roller conveyer, the transfer of heavy marine products becomes easy and the efficiency of auction is promoted.

(13) It is preferable that the temperature of said low temperature zone can be controlled in a temperature range from storage temperature with ice to a temperature for maintaining frozen state of marine products by adjusting cooling temperature of the cooling heat exchanger or cooling flat plate through controlling the temperature of the heat sink for cooling the heat exchanger or the cooling flat plates.

The above invention is related to a setting means of the temperature of the low temperature zone. The system is composed so that the temperature of the low temperature zone can be controlled in accordance with the commodities handled in the auction market. It is suitable that the temperature can be controlled in the temperature zone used for low temperature storage of foodstuffs. For example, it is suitable to make it possible to control the temperature to maintain a low temperature of chilling zone, i.e. lower than contact icing temperature of about 3° C., which is the toxin producing limit temperature of batulinus and breeding limit temperature of erwinieae, including the temperature for maintaining frozen state of the frozen foodstuffs.

(14) It is preferable that current plates are provided at the opening for introduction of cold air to the low temperature zone.

The above invention is related to the composition of the opening for inducing cold air into the low temperature zone formed in the upward-open case body. It is suitable to provide current plates to prevent the cold air from being introduced in a turbulent state.

(15) It is preferable that a cold air producing chamber which is a shallow passage formed under the cooling heat exchanger or cooling flat plate of which one of the heat transfer faces forms said floor face and the other heat transfer face forms the rear face of the floor, and said rear side heat transfer face is provided with concavities and convexities, fins, or is blast finished.

The above invention is related to the configuration of the cold air producing chamber below the rear side heat transfer face of the cooling heat exchanger or cooling flat plate forming the floor of the upward-open case body. It is suitable to form the cold air producing chamber such that the cross section thereof is thin to form a narrow passage in order to raise the velocity of air flowing in the passage and raise heat transfer efficiency between the air flow and the heat transfer face. The heat transfer face is suitable to be provided with concavities and convexities, fins, or is blast finished.

(16) It is preferable that said cooling heat exchanger or cooling flat plate provided to said floor face or to both of said floor face and inside faces of walls are supplied with the brine cooled by the refrigerating machine which is housed in the space under the floor of the upward-open case body or the brine cooled by a central refrigerating machine which is located outside the system by means of brine piping.

(17) It is preferable that a shut-off valve is attached to the connector fixed to the end of each brine piping which is integrated in said cooling heat exchanger or cooling flat plates installed on said floor face or on both of the floor face and the inside faces of said side walls in order that the leakage of brine is prevented when detaching or attaching said cooling flat plates.

The above invention is related -to the connection between a heat sink apparatus and the cooling heat exchanger or cooling flat plate forming the floor and the cooling flat plates installed on the four side walls of the upward-open case body for forming a low temperature zone. Propylene or salt water is used as a cooling medium. As the heat sink apparatus, a brine cooler is accommodated in the lower part of the case body or a refrigerating unit is provided separately. The heat exchanger and cooling flat plates are connected to the brine piping by mean of touch connectors such as couplers. Automatic shut-off valves are provided to the heat exchanger and cooling flat plates, the brine remains in the heat exchanger and cooling flat plates even after they are detached, and the leakage of brine is prevented.

(18) It is preferable that said upward-open case body is provided with a sunshade sheet to prevent sunlight streams into the low temperature zone.

(19) It is preferable that said upward-open case body is provided with casters or the like at its foot parts, and the vertical position of the floor of the case body is such that putting-on and -down of commodities is easily possible.

It is suitable to attach casters at the foot parts of the upward-open case body for forming a low temperature zone for displaying commodities to make the case body movable. In the case of a cold air introduction type low temperature forming system which is applied for displaying mainly small-sized marine products, it is suitable to compose such that the floor of the case body is positioned at the height corresponding to worker's waist-height to promote the efficiency of loading work.

BEST MODE FOR EMBODIMENT OF THE INVENTION

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
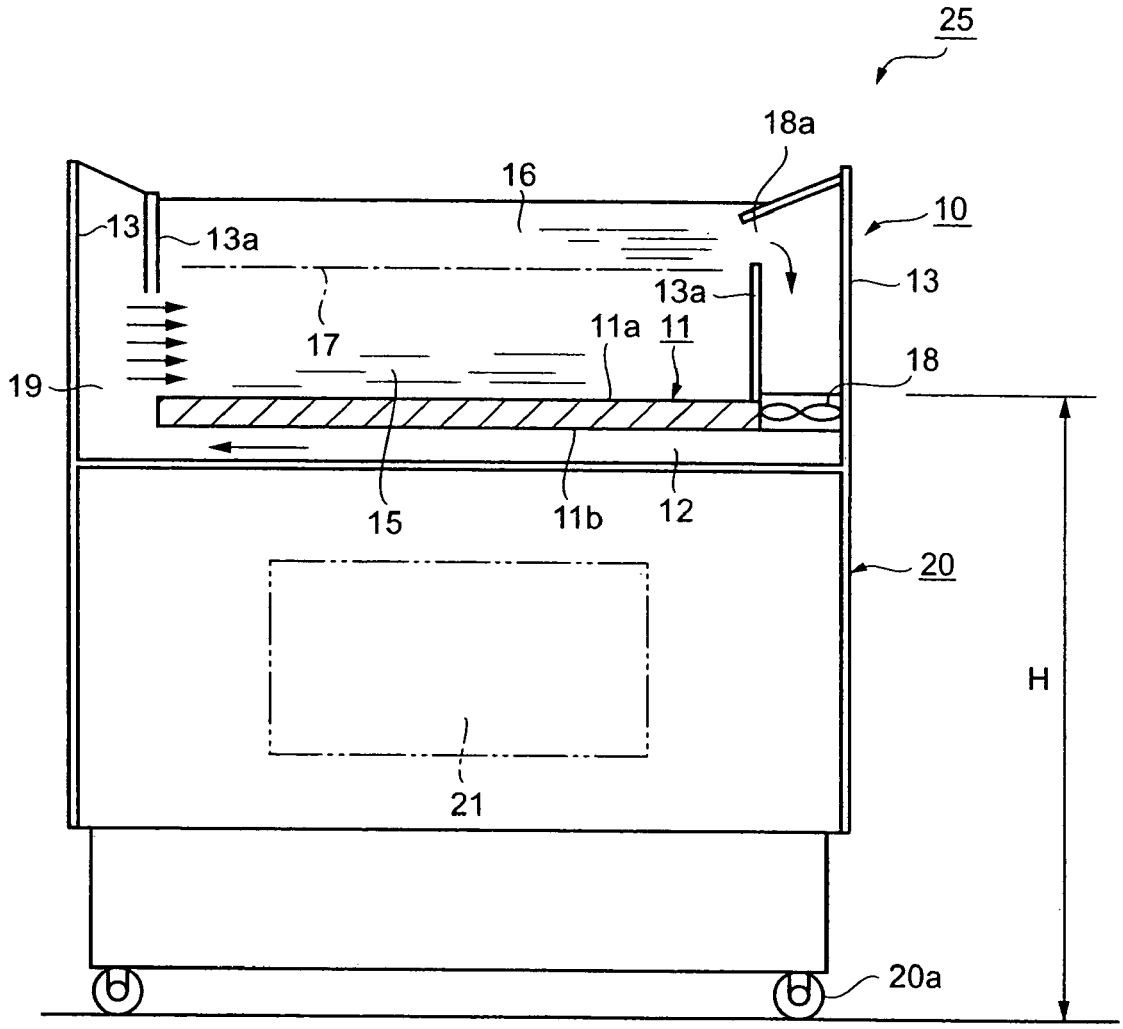
FIG. 1 is a schematic illustration of an embodiment of a low temperature zone forming system capable of complying with forced cold-air circulation according to the present invention in which the low temperature zone is formed by introducing cold air.
Figure 2:
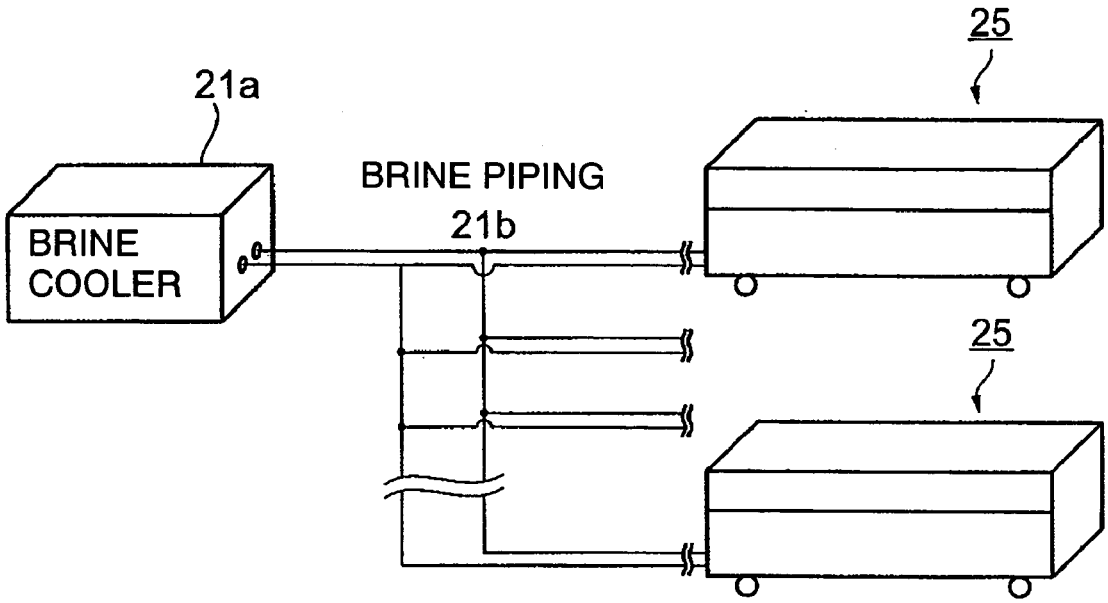
FIG. 2(A) is a schematic block diagram showing when parallel operation of a plurality of the low temperature forming systems of FIG. 1 is performed by use of a brine cooler.
FIG. 2(B) is an illustration showing when marine products for display are carried-in in the low temperature forming system of FIG. 1.
Figure 2:
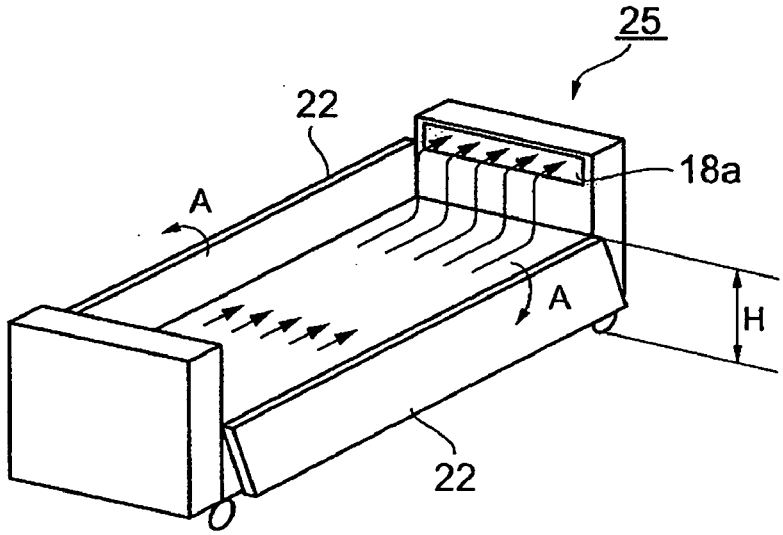
Figure 3:
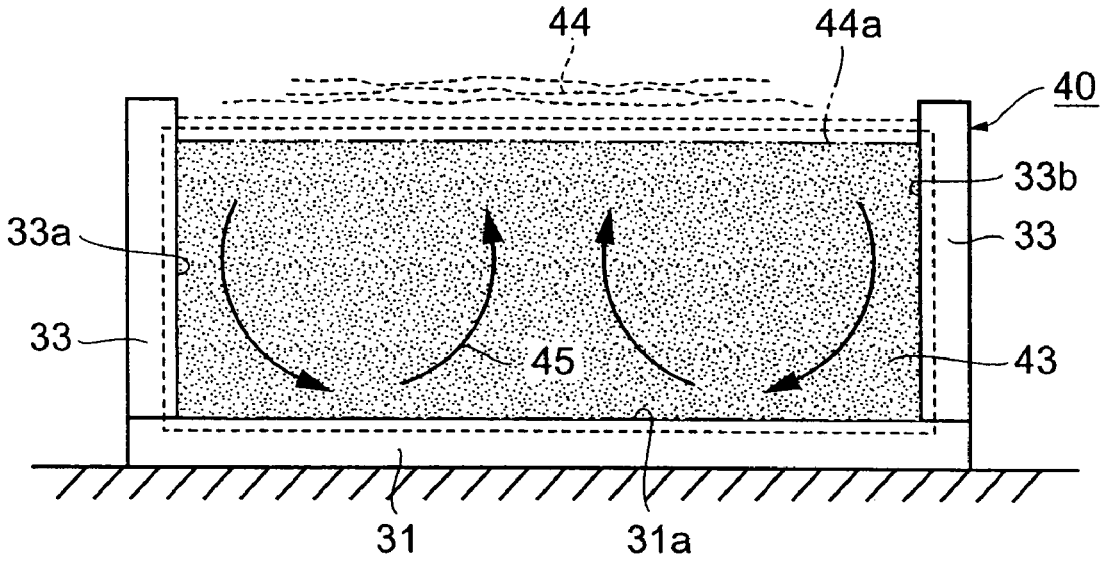
FIG. 3 is an illustration showing a basic pattern of convection in the low temperature zone forming system of the present invention in which the low temperature zone is formed by convection.

FIG. 1 is a schematic illustration of an embodiment of a low temperature zone forming system capable of complying with forced cold-air circulation in which the low temperature zone is formed by introducing cold air, FIG. 2(A) is a schematic block diagram showing when parallel operation of a plurality of the low temperature forming systems of FIG. 1 is performed by use of a brine cooler, and FIG. 2(B) is an illustration showing when marine products for display are carried-in in the low temperature forming system of FIG. 1. FIG. 3 is an illustration showing a basic pattern of convection in the low temperature zone forming system in which the low temperature zone is formed by convection. FIG. 4(A), FIG. 4(B), and FIG. 4(C) are respectively a top plan view, a front elevation, and a side elevation with partially sectional view of the low temperature zone forming system of which the basic pattern of convection is shown in FIG. 3. FIG. 5(A) is a perspective view when a single unit of the low temperature zone forming system of FIG. 4 is operated, and FIG. 5(B) a plurality of the low temperature zone forming system of FIG. 4 are connected.

Figure 4:
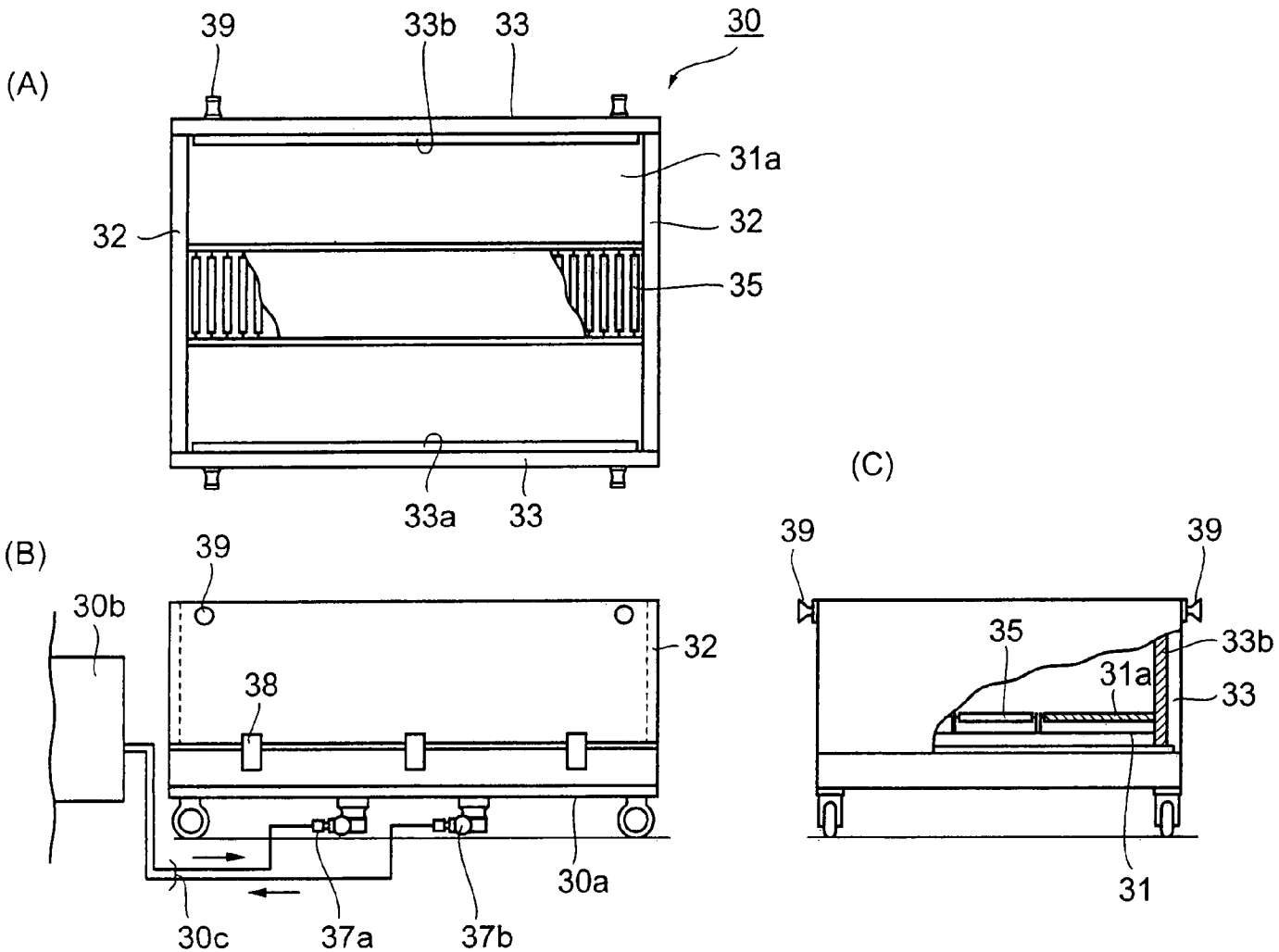
FIG. 4(A), FIG. 4(B), and FIG. 4(C) are respectively a top plan view, a front elevation, and a side elevation with partially sectional view of the low temperature zone forming system of which the basic pattern of convection is shown in FIG. 3.
Figure 6:
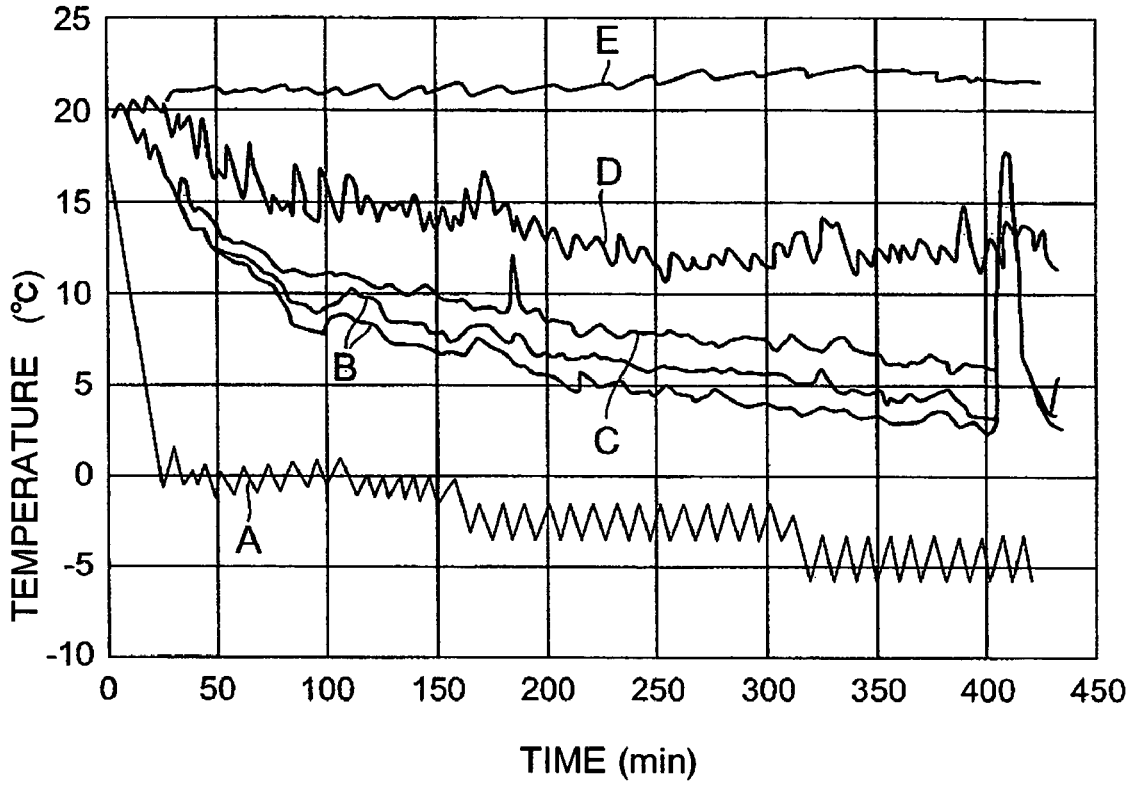
FIG. 6 is a graph showing a cooling test result of changes in temperatures over time at positions different in height from the surface of the table in the low temperature zone forming system of FIG. 4.
Figure 7:
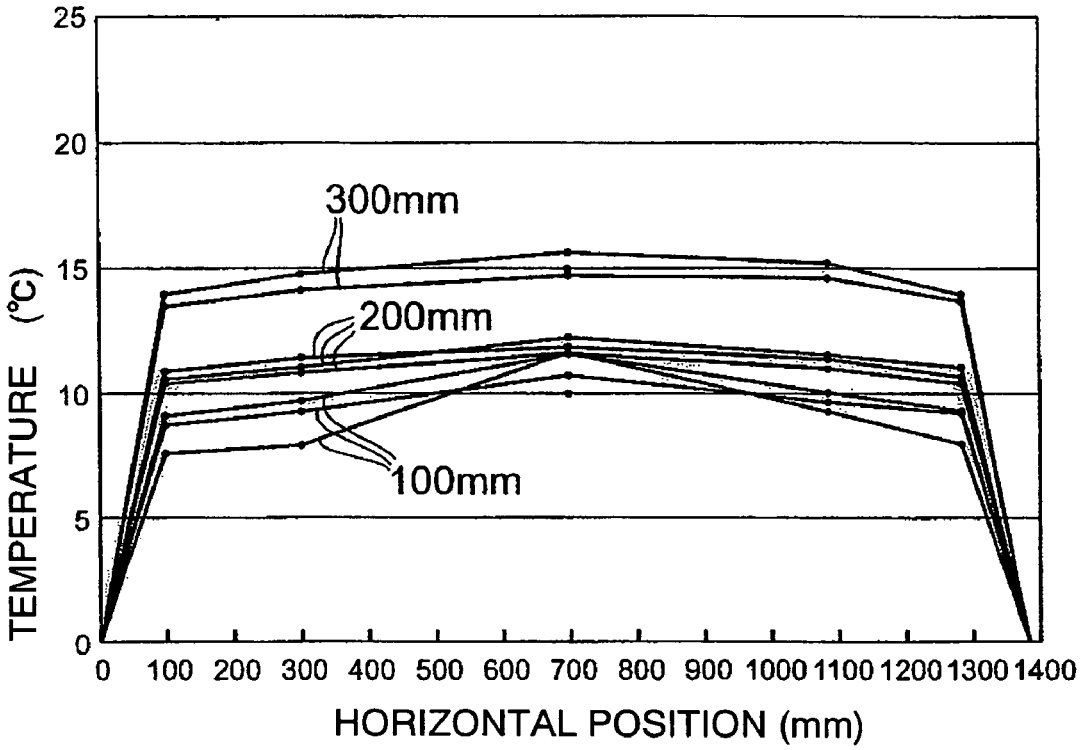
FIG. 7 is a graph showing the distribution of temperatures in a horizontal direction at positions different in height from the surface of the table after 1.5 hours from the start of the cooling test of FIG. 6.
Figure 8:
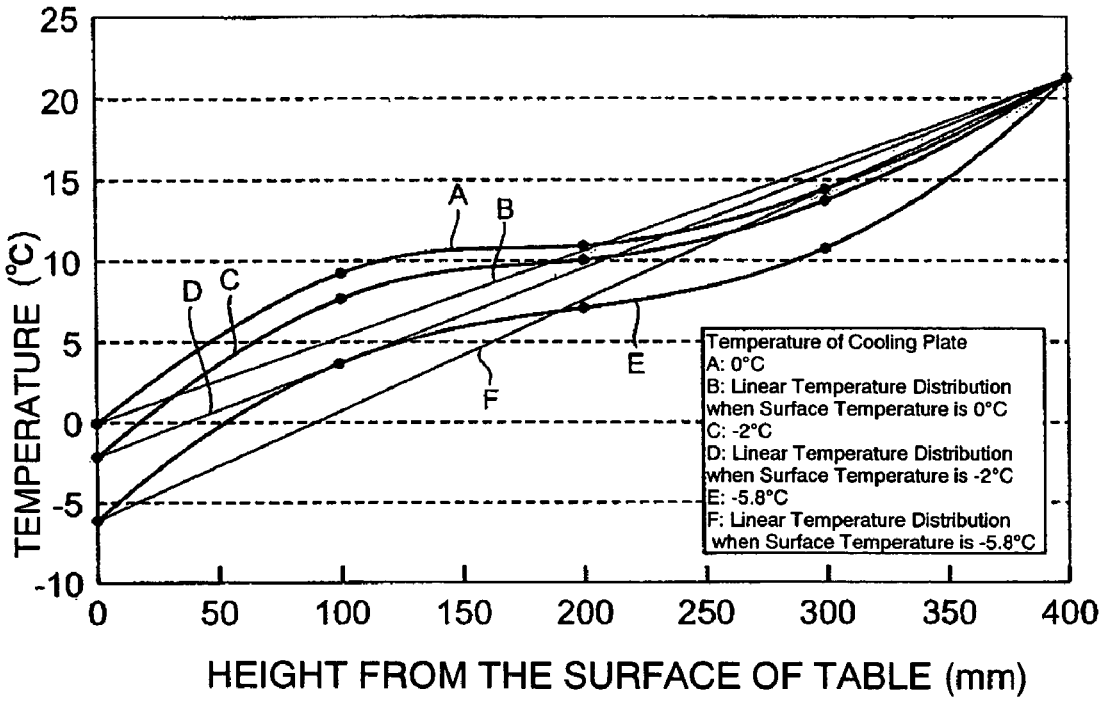
FIG. 8 is a graph showing the distribution of temperatures in a vertical direction in the cooling test of FIG. 6.
Figure 9:
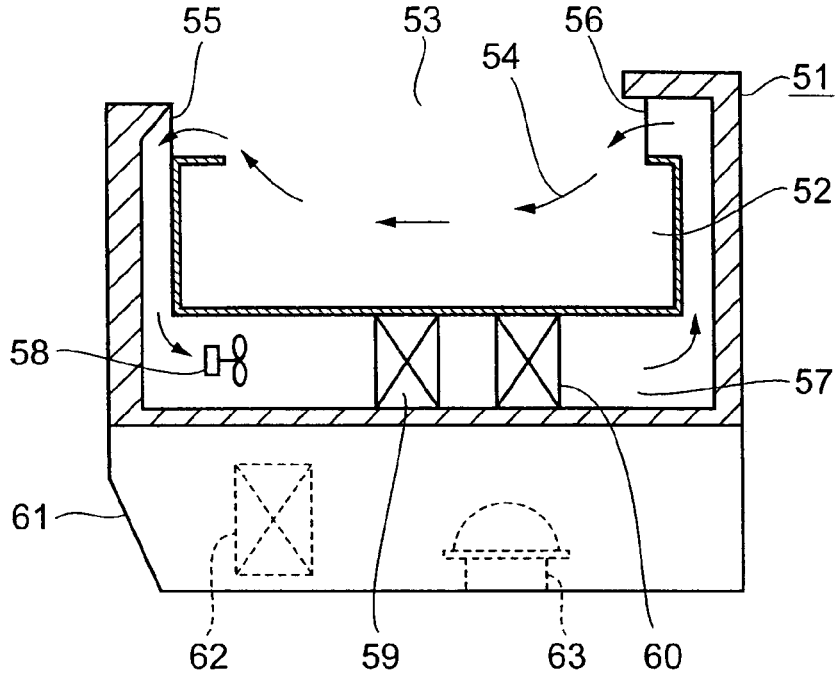
FIG. 9 is a schematic illustration of a prior art refrigerating apparatus in which a cold air curtain is formed across the opening of the apparatus.
Figure 10:
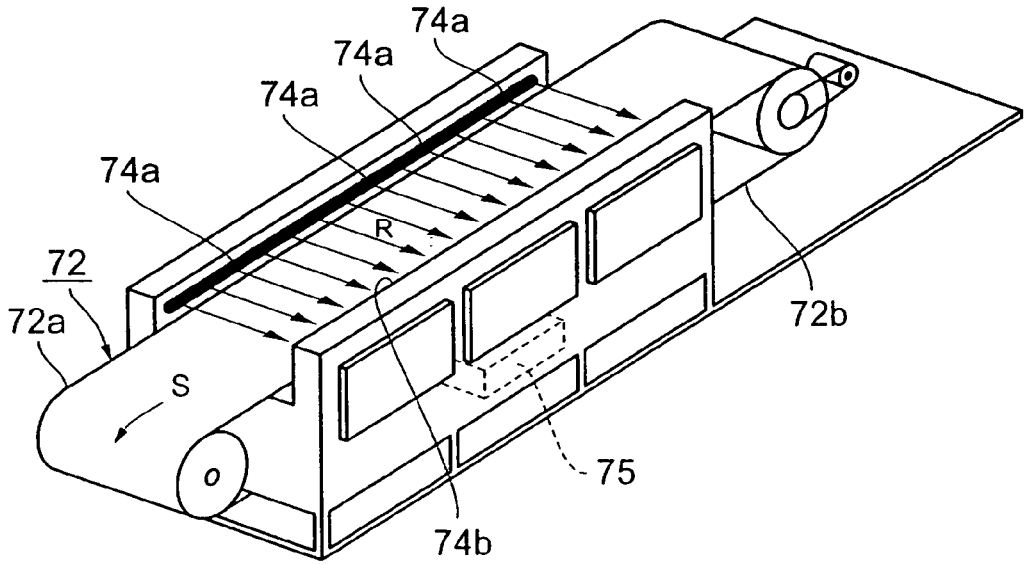
FIG. 10 is a schematic illustration of prior art belt conveyer equipment for transferring cold food.
Figure 11:
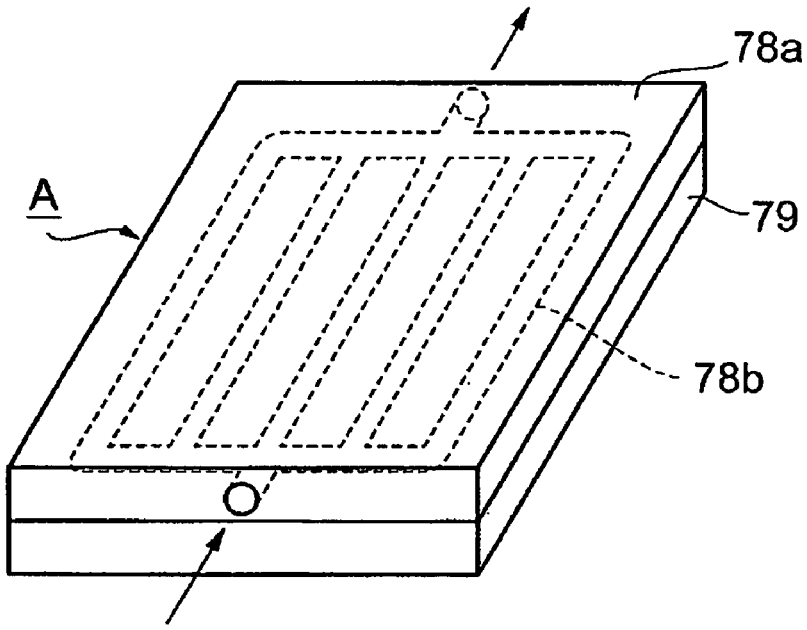
FIG. 11 is a schematic illustration of a prior art marine products displaying apparatus.
Figure 12:
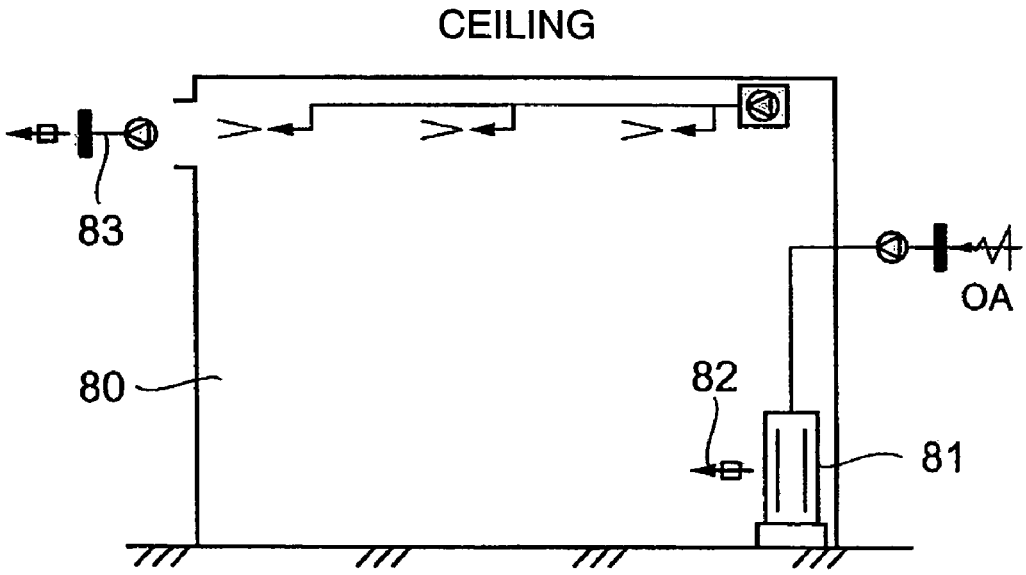
FIG. 12 is a schematic illustration of a prior art ventilation apparatus utilizing thermal stratification for replacing the air in a room.

FIG. 6 is a graph showing a cooling test result of changes in temperatures over time at positions different in height from the surface of the table in the low temperature zone forming system of FIG. 4, FIG. 7 is a graph showing the distribution of temperatures in a horizontal direction at positions different in height from the surface of the table after 1.5 hours from the start of the cooling test, FIG. 8 is a graph showing the distribution of temperatures in a vertical direction.

Referring to FIG. 1, a low temperature zone forming system 25 of the present invention capable of complying with forced cold-air circulation is composed such that a low temperature zone is formed in the upper section of a high deck structure 20 having casters 20*a*. An upward-open case body 10 is provided on the structure, height H from the floor of the market to the bottom floor of the case body 10 being determined such that carrying-in and -out of commodities in the low temperature zone is possible in order to make it easy for workers to carry-in and -out commodities. The case body 10 has inner four side walls 13*a* and outer four side walls 13. A low temperature zone 15 capable of complying with forced cold-air circulation is formed in the space above the surface 11*a* of a heat transfer face 11 serving as the bottom floor of the case body 13 surrounded by said inner walls. The low temperature zone 15 is separated from outside air by a warm air zone 16 of temperature higher than that of the low temperature zone 15 and about equal to that of outside air, reference numeral 17 showing a horizontal boundary of both zones.

Commodities such as marine products are displayed in the low temperature zone 15 to be maintained in a low temperature for auctioning. When replacing commodities or starting operation of the system, cold air is forced into the low temperature zone 15 to form a low temperature with newly introduced cold air.

Said heat transfer face 11*a* of the floor serves as an upper heat transfer face of the cooling flat plate 11 to cool the air staying on the floor for forming the low temperature zone 15. A cold air producing chamber 12 is formed below the lower heat transfer face 11*b* of the cooling flat plate 11, the chamber 12 being an air passage shallow in its depth, the air passing through the passage being cooled by the heat transfer face 11*b*. An admission opening 18*a* communicating to the warm air zone 16 is provided in the right side of the low temperature zone 15, and a fan 18 of variable rotation speed is provided in the passage communicating the opening 18*a* with the cold air producing chamber 12. In the left side of the low temperature zone 15 is formed an opening to introduce the cold air produced in the chamber 12 into the low temperature zone 15, current plates 19 being provided at the opening.

Forced cold-air circulation operation is performed by sucking air from the warm air zone 16 with high velocity by means of the variable speed fan 18, the warm air sucked by the fan 18 is introduced into the cold air producing chamber 12 to be cooled, and the cooled air is introduced into the low temperature zone 15 passing through the current plates 19 through which the air flow is straightened to cool speedily the whole low temperature space by replacing the air in the space speedily.

The air passage constituting the cold air producing chamber 12 is formed to be shallow in depth in order to achieve efficient heat transfer from the lower side heat transfer face 11*b*, and the face 11*b* is provided with concavities and convexities, fins, or is blast finished to improve heat transfer.

When said forced introduction of cold air and replacement of commodities is finished, said fan 18 is switched to low speed operation and cold air is introduced into the low temperature zone at low speed.

Propylene glycol or salt water is used for the brine to cool said cooling flat plate 11 for the sake of food safety, and the brine is cooled by a refrigerating machine 21 accommodated under the case body or by a separate brine cooler 21*a* as shown in FIG. 2(A). A plurality of the forced cold-air circulation type low temperature zone forming system 25 can be connected by means of brine piping 21*b* to perform parallel operation.

The laterally longitudinal walls 22 of the low temperature zone forming system 25 can be turned over in the direction shown by arrow A in FIG. 2(B) in order that commodities can be easily carried-in onto or put down from the floor formed by the cooling flat plate 11 positioned at the height corresponding to worker's waist-height.

In FIG. 3 is shown a basic pattern of convection in the low temperature zone forming system of the present invention in which the low temperature zone is formed by convection. As can be seen in FIG. 3, the convection type low temperature zone 43 is formed in the inside space of an upward-open case body 40 placed on the movable or fixed table provided in a wholesale market or on the floor of the market, a cooling flat plate 31*a* forming the bottom floor of the space in the case body 40. Warm air region 44 consisting of outside air is separated through an intermediary horizontal boundary 44*a*, and the low temperature zone 43 is formed by natural convention 45 above said cooling flat plate 31*a*. The low temperature zone 43 is maintained in a temperature between the contact icing temperature lower than 3° C., which is most suitable for maintaining freshness of marine products, and the temperature necessary to maintain frozen state.

Said low temperature zone 43 is formed by convection between the warm air region 44 formed above the horizontal boundary 44*a* and the low temperature zone 43 as follows.

A cooling flat plate 31*a*, 33*a*, and 33*b* are installed on the floor face and inside faces of walls of the case body 40 respectively, and brine is circulated inside these cooling plates as a cooling medium to maintain the temperature of the cooling surface to a temperature zone near 0° C.~−20° C.

Air layer of temperature lower than that of outside air and higher in density than that of outside air is formed on the faces of the cooling plates 33*a* and 33*b* of the side walls, the cooled air flows down slowly to cause natural convection 45 without involving the warm air of lower density in the warm air region. Thus, the convection occurs between the warm air region 44 separated by the boundary 44*a* and the low temperature zone 43 resulting in the formation of the low temperature zone by convection.

With the composition mentioned above, the low temperature zone 43 is formed without involving polluted outside air, and freshness of the commodities placed on the table which is the floor of the case body can be maintained.

As cold air is not introduced into the low temperature zone, decrease in cooling efficiency due to frosting can be prevented, and also deterioration of accommodated commodities due to the cold air striking the commodities can be prevented.

The temperature of the low temperature zone 43 is set to be a temperature range of lower than 3° C. and near 0° C., which is lower than toxin producing limit temperature of batulinus and breeding limit temperature of erwinieae, and contact icing or maintaining frozen state of the accommodated marine products can be performed, thus storage management of marine commodities is possible.

The convection type low temperature zone forming system of the invention comprises, as shown in FIGS. 4(A), (B), and (C), a chassis 30*a*, an upward-open case body 30 of which the outside wall is covered with insulation material, a brine chilling unit 30*b* provided separately, and a brine piping 30*c*. The upward-open case body 30 comprises, as shown in FIG. 4A, a roller conveyer 35 installed in the center part of the floor of the case body 30, cooling flat plate 31*a*, 31*a* provided adjacent to the conveyer 35 in both sides thereof, and cooling flat plates 33*a* and 33*b* installed respectively on the laterally longitudinal side walls 33, 33 of the case body 30.

The laterally longitudinal side walls 33, 33 are attached by means of hinges 38 so that they can be turned over in the direction indicated by arrow B (see FIG. 5) and rotary stoppers 39 attached to the side walls contact the floor of the market to support them when they are turned over. The shorter side walls 32, 32 of the case body 30 are detachable as shown in FIG. 5(A), and a plurality of low temperature zone forming system can be connected as shown in FIG. 5(B).

Each of the cooling flat plates is formed to be a flat tank or thin plate-like containment shell provided with a brine passage within. Each of the brine piping 30*c* is connected to the brine inlet and outlet of said flat tank or thin plate-like containment shell by means of touch connectors, each connector being provided with automatic shut-off valves, as shown in FIG. 4(B).

Figure 5:
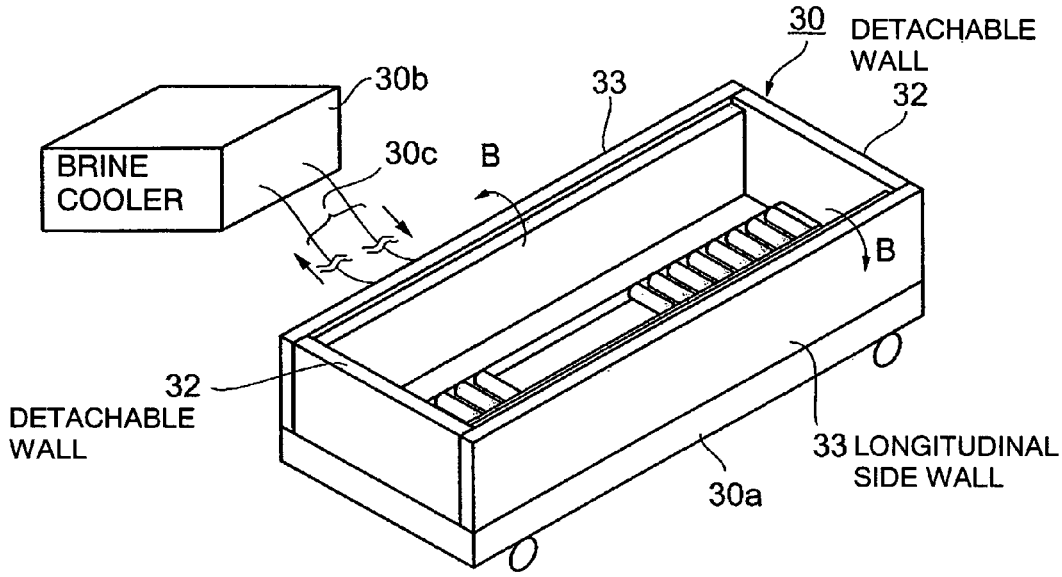
FIG. 5(A) is a perspective view when a single unit of the low temperature zone forming system of FIG. 4 is operated, and FIG. 5(B) a plurality of the low temperature zone forming system of FIG. 4 are connected.
Figure 5:
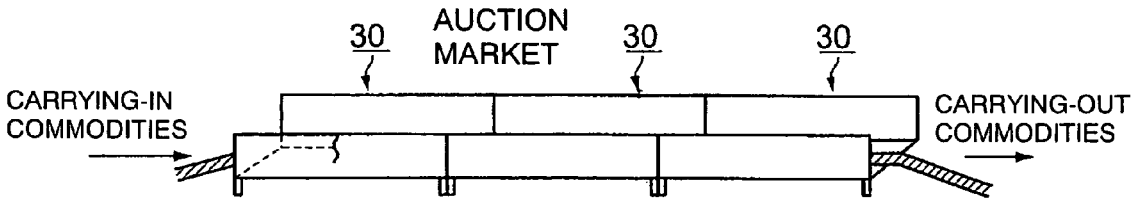

The brine cooled in the brine chilling unit 30*b* shown in FIG. 4(B) and in FIG. 5 circulates flowing through the piping 30*c* and brine passages in the cooling flat plates not shown in the drawings to return to the brine chilling unit in the direction indicated by arrows in FIG. 4(B), the brine piping 30*c* is connected at an inlet 37*a* and outlet 37*b*, for example, by means of rock coupler plugs.

As the roller conveyer 35 is provided in the center part of the floor of the case body 30 along a lateral longitudinal direction as mentioned before, commodities such as marine products can be carried into and out of the low temperature zone efficiently and sanitarily by detaching the shorter side walls 32, 32 as mentioned before while preventing cross-contamination, and efficient and sanitary flow of commodities in the market can be achieved.

When processing of commodities such as cutting of marine products is required, the processing is possible by turning or detaching the laterally longitudinal side wall or walls and bringing out the commodities carried in on the roller conveyer 35 to the cooling flat plate 31*a*, the processing can be done on the cooling flat plate, and the processed commodities can be auctioned immediately.

Each of the cooling flat plates which can be detached or turned over outwardly is provided with automatic shut-off valves at the inlet and outlet for brine, so that the leakage of brine is prevented when detaching or turning-over the cooling flat plates, and the case body has enough heat capacity to maintain low temperature of the zone for a while even if the cooling flat plates are detached or turned over outwardly.

With the construction described above, it is possible to efficiently carry in and out commodities and efficiently clean the commodities, thus the safety management of foodstuffs is made possible.

As said brine is used propylene glycol or salt water, and when salt water is used, foodstuffs are not damaged by leaked salt water if leakage occurs.

Example of Test Result

A result of cooling test without placing commodities on the table (no load test) will be explained hereunder.

The dimension of the table of the tested apparatus is 1400×2000 mm.

(a) Changes in temperatures over time at positions different in height from the surface of the table are shown in FIG. 6.

In the graph, each symbol corresponds to the height from the surface of the table in the low temperature zone as follows:

A: 0 mm

B: 100 mm

C: 200 mm

D: 300 mm

E: at the position level with the top of the side walls

The temperature of brine was changed in three steps, that was, −1° C.~1° C., −3° C.~−1° C., −6° C.~−3.5° C., as clearly recognized by the curve denoted by A(the temperature of the surface of the table).

In the graph is also shown the temperature rise when one of the side walls was opened after 400 minutes from the start of the test for 7.5 minutes and then closed. It is recognized that the temperature was restored to low temperature after 16 minutes.

(b) Temperature distribution in a horizontal direction after 1.5 hours from the start of the test is shown in FIG. 7.

The temperature of the surface of the table was 0° C. and ambient temperature was 21.6° C. It is recognized from the graph that the region lower than 200 mm from the table face was cooled to a temperature lower than 12° C. and at 300 mm cooled to 13° C.~16° C.

It is also recognized that temperatures are highest at the center positions remotest from the side walls for cooling air.

(c) Temperature distribution in a vertical direction with the temperature of the cooling flat plate taken as a parameter is shown in FIG. 8.

Each of thin straight lines B, D, and F in the graph shows distribution of temperature when it is supposed that the temperature rises linearly with increase in height from the surface of table from the surface to 400 mm.

From the graph, it is recognized that actual temperature was higher than that of linear distribution at 100 mm, about the same as that of linear distribution at 200 mm, and lower by about 3° C. than that of linear distribution at 300 mm from the surface. This is considered to be attributable to the low temperature stratification as shown in FIG. 3.

From the above results, it is recognized that a low temperature zone of which temperature is lower than 10° C. at the positions lower than 200 mm from the surface of the table was formed.

(d) Heat load(amount of heat taken away by brine) per 1 $m^2$ of the cooling flat plate was calculated as follows:
when brine temperature is 0° C.: 504 $W/m^2$,
when brine temperature is −2° C.: 540 $W/m^2$, and
when brine temperature is −5° C.: 576 $W/m^2$.

INDUSTRIAL APPLICABILITY

The present invention brings about the following effects by the constitution described in the forgoing:

(a) Low temperature storage of commodities is possible in a wholesale market in entire process of handling commodities such as marine products from carrying-in to shipment thereof including auction in between while maintaining freshness of commodities by forming on a movable or fixed table a low temperature zone separated from a contaminated atmosphere.

(b) Damaging of fishes by cold air involving contaminated outside air is prevented, since a low temperature zone is formed without involving outside air.

(c) In the case of a low temperature zone formed by convection type thermal stratification, reduction in cooling efficiency due to frosting does not occur as is often the case with a forced cold-air circulation type.

(d) Cooling function can be maintained if the brine piping is shut-off owing to the large cooling storage capacity of the system.

(e) A plurality of the system can be connected as necessary so that carrying-in, auction, and shipment of commodities can be done in a lump in a wholesale market, resulting in an efficient flow of commodities in the market, as cooling flat plates each having a flat heat transfer surface are provided adjacent to a roller conveyer installed in the center part of the floor of the upward-open case body which has cooling flat plates each having a flat heat transfer surface installed on the inside faces of the four side walls thereof.

(f) Processing such as cutting of commodities is possible by using the cooling flat plate having a flat heat transfer surface as a chopping board.

(g) Cleaning is easy and safety and sanitary management can be performed more positively, for the structure is simple and side walls are detachable or can be turned over outwardly.

(h) As propylene glycol or salt water is used for the brine for cooling the cooling flat plates, the foodstuffs are free of contamination by the leakage of the brine.

(i) As a touch connector with automatic shut-off valve is used for connecting brine piping to the cooling flat plate, leakage of brine when detaching or attaching the side walls can be suppressed to a minimum.

The invention claimed is:

1. A low temperature zone forming system including an upward-open case body for displaying commodities, the case body confining a space surrounded by a floor face and four side walls, to be used for maintaining freshness of fresh marine products in a wholesale market, wherein a thermally stratified low temperature zone having temperature distribution in a vertical direction is formed above said floor face, and further wherein said floor face constitutes a cooling heat exchanger having heat transfer faces on both sides thereof, one of the heat transfer faces forming a cooling floor face and the other of the heat transfer faces forming a heat transfer face to perform heat exchange in a cold air producing chamber formed in a rear face side of the floor face, wherein warm air in a warm air zone in an upside opening region of said case body is introduced into said cold air producing chamber to be cooled therein, and cold air produced in the chamber is introduced into the low temperature zone formed above said one of the heat transfer faces to form a new cold air stratified zone.

2. A low temperature zone forming system including an upward-open case body for displaying commodities, the case body confining a space surrounded by a floor face and four side walls, to be used for maintaining freshness of fresh marine products in a wholesale market, wherein a thermally stratified low temperature zone having temperature distribution in a vertical direction is formed above said floor face, and cold air is introduced in a lower part of said low temperature zone as necessary at low velocity in an ordinary operation and the introduction of cold air is switched to a forced introduction to form a stratified low temperature zone having a required temperature distribution in a vertical direction, and further wherein said floor face constitutes a heat exchanger comprising a cooling flat plate having heat transfer faces on both sides thereof, one of the heat transfer faces forming a cooling floor face and the other of the heat transfer faces forming a heat transfer face to perform heat exchange in a cold air producing chamber formed in a rear face side of the floor face, wherein warm air in a warm air zone in an upside opening region of said case body is introduced into said cold air producing chamber to be cooled therein, and cold air produced in the chamber is introduced into the low temperature zone formed above said one of the heat transfer faces to form a new cold air stratified zone.

3. The low temperature zone forming system according to claim 2, wherein a separate cooling panel is attached to the rear face of said floor face, the cold air produced by means of the panel is forced into the low temperature zone above the floor face to form a cold air stratified zone of required temperature.

4. The low temperature zone forming system according to claim 1, wherein cold air is introduced in a lower part of said low temperature zone as necessary.

5. The low temperature zone forming system according to claim 4, wherein said cold air is introduced at low velocity in an ordinary operation and the introduction of cold air is switched to a forced introduction to form a stratified low temperature zone having a required temperature distribution in a vertical direction.

6. The low temperature zone forming system according to claim 1, wherein said floor face is a one-side- cooling flat plate having a flat heat transfer face on one side thereof, and the formation of the thermal stratification is possible in a short time period by concentrating cooling capacity to said heat transfer face.

7. The low temperature zone forming system according to claim 1, wherein an inside face of said four side walls and said floor face are composed to be cooling flat plates, so that a convection type cold air stratified zone is formed by the low temperature zone formed by the convection between a descending cold air current produced due to a cooling of air by the cooling plates of the four side walls and the cold air zone produced due to the cooling of air by the cooling plates of the floor and a hot air region formed above said low temperature zone.

8. The low temperature zone forming system according to claim 7, wherein cooling flat plates are provided on inside faces of laterally longitudinal walls among the four side walls.

9. A low temperature zone forming system including an upward-open case body for displaying commodities, the case body confining a space surrounded by a floor face and four side walls, to be used for maintaining freshness of fresh marine products in a wholesale market, wherein a thermally stratified low temperature zone having temperature distribution in a vertical direction is formed above said floor face, and further wherein a transfer section consisting of a roller conveyer is installed on part of said floor face in a laterally longitudinal direction or in a crosswise direction, and a cooling flat plate or plates which can serve as chopping boards are provided in a position or positions other than the transfer section.

10. The low temperature zone forming system according to claim 9, wherein the roller conveyer is provided on said floor face in a laterally longitudinal direction.

11. The low temperature zone forming system according to claim 1, wherein said four side walls can be turned over outward or detached, and when storing commodities in the case body, the walls are recovered to an erect state with the walls closely contacted with the floor face to be able to again allow the formation of the low temperature zone.

12. The low temperature zone forming system according to claim 1, wherein the temperature of said low temperature zone can be controlled in a temperature range from storage temperature with ice to a temperature for maintaining a frozen state of marine products by adjusting a cooling temperature of the cooling heat exchanger or a cooling flat plate through controlling the temperature of a heat sink for cooling the cooling heat exchanger or the cooling flat plate.

13. The low temperature zone forming system according to claim 1, wherein current plates are provided at an opening for introducing cold air to the low temperature zone.

14. The low temperature zone forming system according to claim 1, wherein a cold air producing chamber which is a shallow passage formed under the cooling heat exchanger or cooling flat plate of which one of the heat transfer faces forms said floor face and the other heat transfer face forms a rear face of the floor, and said rear side heat transfer face is provided with concavities and convexities, fins, or is blast finished.

15. The low temperature zone forming system according to claim 1, wherein said cooling heat exchanger or cooling flat plate provided to said floor face or to both of said floor face and inside faces of the side walls are supplied with a brine cooled by a refrigerating machine which is housed in a space under the floor face of the upward-open case body or the brine cooled by a central refrigerating machine which is located outside the system by means of brine piping.

16. The low temperature zone forming system according to claim 1, wherein a shut-off valve is attached to a connector fixed to an end of each brine piping which is integrated in said cooling heat exchanger or cooling flat plates installed on said floor face or on both of the floor face and the inside faces of said side walls in order that a leakage of brine is prevented when detaching or attaching said cooling flat plates.

17. The low temperature zone forming system according to claim 1, wherein said upward-open case body is provided with a sunshade sheet to prevent sunlight streams into the low temperature zone.

18. The low temperature zone forming system according to claim 1, wherein said upward-open case body is provided with casters or the like at its foot parts, and a vertical position of the floor face of the case body is such that putting-on and -down of commodities is easily possible.

* * * * *